US008809823B1

(12) United States Patent
Senekerimyan et al.

(10) Patent No.: US 8,809,823 B1
(45) Date of Patent: Aug. 19, 2014

(54) SYSTEM AND METHOD FOR CONTROLLING DROPLET TIMING AND STEERING IN AN LPP EUV LIGHT SOURCE

(71) Applicant: Cymer, LLC, San Diego, CA (US)

(72) Inventors: Vahan Senekerimyan, San Diego, CA (US); Martijn Wehrens, Waalre (NL)

(73) Assignee: ASML Netherlands B.V., Veldhoven (NL)

( * ) Notice: Subject to any disclaimer, the term of this patent is extended or adjusted under 35 U.S.C. 154(b) by 0 days.

(21) Appl. No.: 14/137,030

(22) Filed: Dec. 20, 2013

Related U.S. Application Data

(63) Continuation-in-part of application No. 14/037,817, filed on Sep. 26, 2013.

(51) Int. Cl.
*H05G 2/00* (2006.01)

(52) U.S. Cl.
CPC ..... *H05G 2/008* (2013.01)
USPC ..... 250/504 R

(58) Field of Classification Search
USPC ..... 250/504 R
See application file for complete search history.

(56) References Cited

U.S. PATENT DOCUMENTS

| | | | | |
|---|---|---|---|---|
| 7,068,367 | B2 * | 6/2006 | Stobrawa et al. | 356/318 |
| 8,324,600 | B2 * | 12/2012 | Hayashi et al. | 250/504 R |
| 2013/0062539 | A1 * | 3/2013 | Hayashi et al. | 250/504 R |

* cited by examiner

*Primary Examiner* — Kiet T Nguyen
(74) *Attorney, Agent, or Firm* — Gard & Kaslow LLP

(57) ABSTRACT

A method and apparatus for improved control of the trajectory and timing of droplets of target material in a laser produced plasma (LPP) extreme ultraviolet (EUV) light system is disclosed. A droplet illumination module generates a laser curtain, and sensors detect the droplets as they pass through the curtain. One sensor in combination with a controller detects the position of the droplets relative to a desired trajectory to the irradiation site so that a signal can be sent to an actuator of a droplet generator to adjust orientation of the droplet generator and direct subsequent droplets to the irradiation site, as in the prior art. A second sensor, or droplet detection module, also detects each droplet as it passes through the curtain, and in combination with a controller determines when the source laser should generate a pulse so that the pulse will arrive at the irradiation site at the same time as the droplet, and sends a signal to the source laser to fire at the correct time.

14 Claims, 5 Drawing Sheets

SYSTEM AND METHOD FOR CONTROLLING DROPLET TIMING AND STEERING IN AN LPP EUV LIGHT SOURCE

This application is a continuation-in-part of U.S. patent application Ser. No. 14/037,817, filed Sep. 26, 2013, entitled "System and Method for Controlling Droplet Timing in an LPP EUV Light Source."

FIELD OF THE INVENTION

The present invention relates generally to laser produced plasma extreme ultraviolet light sources. More specifically, the invention relates to a method and apparatus for irradiating droplets of target material in an LPP EUV light source.

BACKGROUND OF THE INVENTION

The semiconductor industry continues to develop lithographic technologies which are able to print ever-smaller integrated circuit dimensions. Extreme ultraviolet ("EUV") light (also sometimes referred to as soft x-rays) is generally defined to be electromagnetic radiation having wavelengths of between 10 and 120 nm. EUV lithography is currently generally considered to include EUV light at wavelengths in the range of 10-14 nm, and is used to produce extremely small features, for example, sub-32 nm features, in substrates such as silicon wafers. These systems must be highly reliable and provide cost effective throughput and reasonable process latitude.

Methods to produce EUV light include, but are not necessarily limited to, converting a material into a plasma state that has one or more elements, e.g., xenon, lithium, tin, indium, antimony, tellurium, aluminum, etc., with one or more emission line(s) in the EUV range. In one such method, often termed laser produced plasma ("LPP"), the required plasma can be produced by irradiating a target material, such as a droplet, stream or cluster of material having the desired line-emitting element, with a laser pulse at an irradiation site. The target material may contain the spectral line-emitting element in a pure form or alloy form, for example, an alloy that is a liquid at desired temperatures, or may be mixed or dispersed with another material such as a liquid.

A droplet generator heats the target material and extrudes the heated target material as droplets which travel along a trajectory to the irradiation site to intersect the laser pulse. Ideally, the irradiation site is at one focal point of a reflective collector. When the laser pulse hits the droplets at the irradiation site, the droplets are vaporized and the reflective collector causes the resulting EUV light output to be maximized at another focal point of the collector.

In earlier EUV systems, a laser light source, such as a $CO_2$ laser source, is on continuously to direct a beam of light to the irradiation site, but without an output coupler so that the source builds up gain but does not lase. When a droplet of target material reaches the irradiation site, the droplet causes a cavity to form between the droplet and the light source and causes lasing within the cavity. The lasing then heats the droplet and generates the plasma and EUV light output. In such "NoMO" systems (called such because they do not have a master oscillator) no timing of the arrival of the droplet at the irradiation site is needed, since the system only lases when a droplet is present there.

However, it is necessary to track the trajectory of the droplets in such systems to insure that they arrive at the irradiation site. If the output of the droplet generator is on an inappropriate path, the droplets may not pass through the irradiation site, which may result in no lasing at all or reduced efficiency in creating EUV energy. Further, plasma formed from preceding droplets may interfere with the trajectory of succeeding droplets, pushing the droplets out of the irradiation site.

Some prior art NoMo systems accomplish such tracking of the droplets by passing a low power laser through lenses to create a "curtain," i.e., a thin plane of laser light through which the droplets pass on the way to the irradiation site. When a droplet passes through the plane, a flash is generated by the reflection of the laser light of the plane from the droplet. The location of the flash may be detected to determine the trajectory of the droplet, and a feedback signal sent to a steering mechanism to redirect the output of the droplet generator as necessary to keep the droplets on a trajectory that carries them to the irradiation site.

Other prior art NoMo systems improve on this by using two curtains between the droplet generator and the irradiation site, one closer to the irradiation site than the other. The flash created as a droplet passed through the first curtain may, for example, be used to control a "coarse" steering mechanism, and the flash from the second curtain used to control a "fine" steering mechanism, to provide greater control over correction of the droplet trajectory than when only a single curtain is used.

More recently, NoMO systems have generally been replaced by "MOPA" systems, in which a master oscillator and power amplifier form a source laser which may be fired as and when desired, regardless of whether there is a droplet present at the irradiation site or not, and "MOPA PP" ("MOPA with pre-pulse") systems in which a droplet is sequentially illuminated by more than one light pulse. In a MOPA PP system, a "pre-pulse" is first used to heat, vaporize or ionize the droplet and generate a weak plasma, followed by a "main pulse" which converts most or all of the droplet material into a strong plasma to produce EUV light emission.

One advantage of MOPA and MOPA PP systems is that the source laser need not be on constantly, in contrast to a NoMO system. However, since the source laser in such a system is not on constantly, firing the laser at an appropriate time so as to deliver a droplet and a main laser pulse to the desired irradiation site simultaneously for plasma initiation presents additional timing and control problems beyond those of prior systems. It is not only necessary for the main laser pulses to be focused on an irradiation site through which the droplet will pass, but the firing of the laser must also be timed so as to allow the main laser pulses to intersect the droplet when it passes through that irradiation site in order to obtain a good plasma, and thus good EUV light. In addition, in a MOPA PP system, the pre-pulse must target the droplet very accurately, and at a slightly different location than the irradiation site.

What is needed is an improved way of controlling both the trajectory of the droplets and the timing with which they arrive at the irradiation site, so that when the source laser is fired it will irradiate the droplets at the irradiation site.

SUMMARY OF THE INVENTION

Disclosed herein are a method and apparatus for controlling the trajectory and timing of droplets of target material in an EUV light source.

In one embodiment, a system is disclosed for timing the firing of a source laser in an extreme ultraviolet laser produced plasma (EUV LPP) light source having a droplet generator which releases a droplet at a known speed, the source laser firing pulses at an irradiation site, comprising: a droplet illumination module comprising a first line laser configured to generate a first laser curtain between the droplet generator and the irradiation site; a droplet detection module comprising a first sensor configured to detect a flash when the droplet passes through the first laser curtain; a first controller configured to: determine, based upon the flash as detected by the first sensor, a known distance from the first curtain to the irradiation site, and the known speed of the droplet, a time when the source laser should fire a pulse so as to irradiate the droplet when the droplet reaches the irradiation site; and generate a timing signal instructing the source laser to fire at the determined time; a second sensor configured to detect the flash when the droplet passes through the first laser curtain; and a second controller configured to determine, based upon the flash as detected by the second sensor, that the droplet is not on a desired trajectory leading to the irradiation site and providing a signal indicating an adjustment to a direction in which the droplet generator releases a subsequent droplet which will place the subsequent droplet on the desired trajectory.

Another embodiment discloses a method for timing the firing of a source laser in an EUV LPP light source having a droplet generator which releases a droplet at a known speed, the source laser firing pulses at an irradiation site, comprising: generating a first laser curtain located between the droplet generator and the irradiation site; detecting by a first sensor a flash when the droplet passes through the first laser curtain; determining from the flash as detected by the first sensor that the droplet is not on a desired trajectory leading to the irradiation site and providing a signal indicating an adjustment to a direction in which the droplet generator releases a subsequent droplet which will place the subsequent droplet on the desired trajectory; detecting by a second sensor the flash when the droplet passes through the first laser curtain; and determining, based upon the flash as detected by the second sensor, a known distance from the first curtain to the irradiation site, and the known speed of the droplet, a time when the source laser should fire a pulse so as to irradiate the droplet when the droplet reaches the irradiation site, and generating a timing signal instructing the source laser to fire at the determined time.

Still another embodiment discloses a non-transitory computer readable storage medium having embodied thereon instructions for causing a computing device to execute a method for timing the firing of a source laser in an EUV LPP light source having a droplet generator which releases a droplet at a known speed, the source laser firing pulses at an irradiation site, the method comprising: generating a first laser curtain located between the droplet generator and the irradiation site; detecting by a first sensor a flash when the droplet passes through the first laser curtain; determining from the flash as detected by the first sensor that the droplet is not on a desired trajectory leading to the irradiation site and providing a signal indicating an adjustment to a direction in which the droplet generator releases a subsequent droplet which will place the subsequent droplet on the desired trajectory; detecting by a second sensor the flash when the droplet passes through the first laser curtain; and determining, based upon the flash as detected by the second sensor, a known distance from the first curtain to the irradiation site, and the known speed of the droplet, a time when the source laser should fire a pulse so as to irradiate the droplet when the droplet reaches the irradiation site, and generating a timing signal instructing the source laser to fire at the determined time.

DETAILED DESCRIPTION OF THE INVENTION

The present application describes a method and apparatus for improved control of the trajectory and timing of droplets in a laser produced plasma (LPP) extreme ultraviolet (EUV) light system.

In one embodiment, a droplet illumination module generates two laser curtains for detecting the droplets of target material. Both curtains are used for detecting the position of the droplets relative to a desired trajectory to the irradiation site in order to allow steering of the droplets. If both curtains are operating, one may be used for "coarse" steering and one for "fine" steering as in prior art NoMo systems. However, in some embodiments, either curtain may be used independently for steering, thus allowing for continued steering of droplets should one curtain fail to function for some reason.

One of the curtains is also used to determine when the source laser should generate pulses so that a pulse arrives at the irradiation site at the same time as each droplet. A droplet detection module detects the droplets as they pass through one of the curtains and determines when the source laser should fire a pulse to hit each droplet at the irradiation site.

In the case of a MOPA PP source laser, the combination of a pre-pulse and main pulse are hereafter referred to as a single pulse, as the time between them is much shorter than the time between successive pulses in a MOPA source laser. Further, the pre-pulse is followed by the main pulse quickly enough that, when properly timed, both will hit a droplet, the main pulse hitting the droplet at the irradiation site and the pre-pulse at a location slightly before the irradiation site in the droplet trajectory. How to properly irradiate a droplet with both a pre-pulse and main pulse in this fashion is known to those of ordinary skill in the art.

Figure 1:
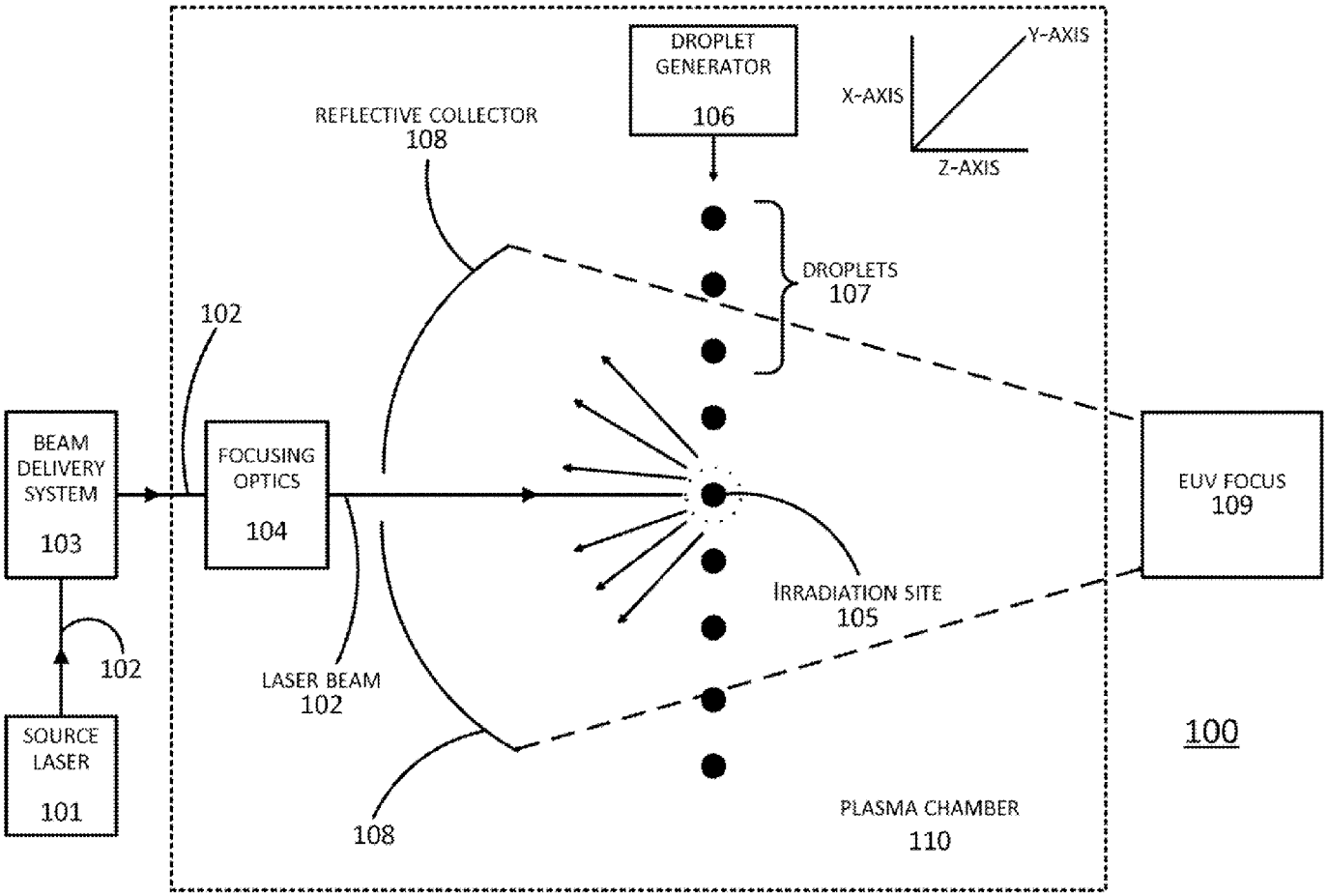
FIGURE 1 (Prior art)
FIG. 1 is an illustration of some of the components of a typical prior art embodiment of an LPP EUV system.

FIG. 1 illustrates a cross-section of some of the components of a typical LPP EUV system 100 as is known in the prior art. A source laser 101, such as a $CO_2$ laser, produces a laser beam (or a series of pulses) 102 that passes through a beam delivery system 103 and through focusing optics 104. Focusing optics 104 may, for example, be comprised of one or more lenses or mirrors, and has a nominal focal spot at an irradiation site 105 within a plasma chamber 110. A droplet generator 106 produces droplets 107 of an appropriate target material that, when hit by laser beam 102, produces a plasma which emits EUV light. In some embodiments, there may be multiple source lasers 101, with beams that all converge on focusing optics 104.

Irradiation site 105 is preferably located at a focal spot of collector 108, which has a reflective interior surface and focuses the EUV light from the plasma at EUV focus 109, a second focal spot of collector 108. For example, the shape of collector 108 may comprise a portion of an ellipsoid. EUV focus 109 will typically be within a scanner (not shown) containing pods of wafers that are to be exposed to the EUV light, with a portion of the pod containing wafers currently being irradiated being located at EUV focus 109.

For reference purposes, three perpendicular axes are used to represent the space within the plasma chamber 110 as illustrated in FIG. 1. The vertical axis from the droplet generator 106 to the irradiation site 105 is defined as the x-axis; droplets 107 travel generally downward from the droplet generator 106 in the x-direction to irradiation site 105, although as described above in some cases the trajectory of the droplets may not follow a straight line. The path of the laser beam 102 from focusing optics 104 to irradiation site 105 in one horizontal direction is defined as the z-axis, and the y-axis is defined as the horizontal direction perpendicular to the x-axis and the z-axis.

As above, in some prior art embodiments, a closed-loop feedback control system may be used to monitor the trajectory of the droplets 107 so that they arrive at irradiation site 105. Such a feedback system again typically comprises a line laser which generates a planar curtain between the droplet generator 106 and irradiation site 105, for example by passing the beam from the line laser through a combination of spherical and cylindrical lenses. One of skill in the art will appreciate how the planar curtain is created, and that although described as a plane, such a curtain does have a small but finite thickness.

Figure 2:
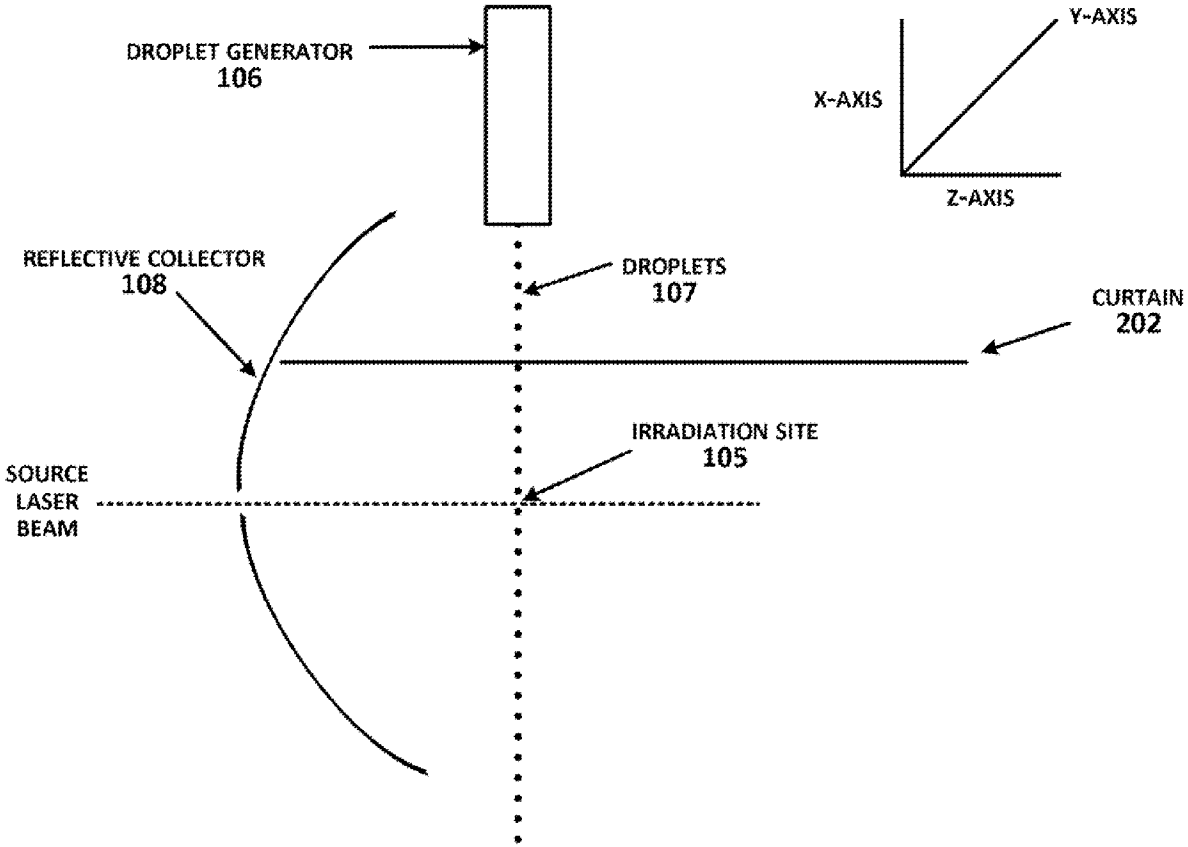
FIGURE 2 (Prior art)
FIG. 2 is a simplified illustration showing some of the components of another prior art embodiment of an LPP EUV system.

FIG. 2 is a simplified illustration showing some of the components of a prior art LPP EUV system such as is shown in FIG. 1, with the addition of a planar curtain 202 which may be created by a line laser (not shown) as described above. Curtain 202 extends primarily in the y-z plane, i.e., the plane defined by the y- and z-axes (but again has some thickness in the x-direction), and is located between the droplet generator 106 and irradiation site 105.

When a droplet 107 passes through curtain 202, the reflection of the laser light of curtain 202 from the droplet 107 creates a flash which may be detected by a sensor (in some prior art embodiments this is called a narrow field, or NF, camera, not shown) and allows the droplet position along the y- and/or z-axis to be detected. If the droplet 107 is on a trajectory that leads to the irradiation site 105, here shown as a straight line from the droplet generator 106 to irradiation site 105, no action is required.

However, if the droplet 107 is displaced from the desired trajectory in either the y- or z-direction, a logic circuit determines the direction in which the droplets should move so as to reach irradiation site 105, and sends appropriate signals to one or more actuators to re-align the outlet of droplet generator 106 in a different direction to compensate for the difference in trajectory so that subsequent droplets will reach irradiation site 105. Such feedback of the droplet trajectory may be performed on a droplet-by-droplet basis, and correction implemented on the trajectory within the mechanical adjustment capability of the equipment. The manner of such feedback and correction are known to one of skill in the art.

Figure 3:
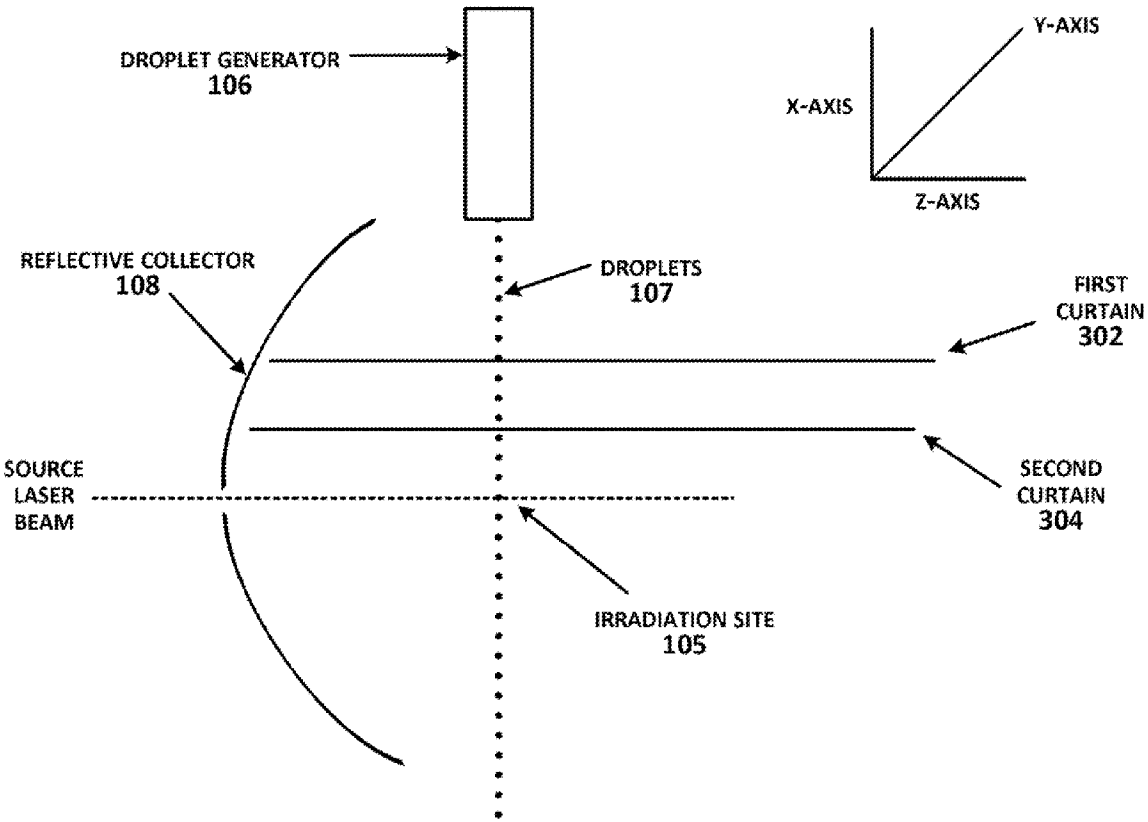
FIGURE 3 (Prior art)
FIG. 3 is another simplified illustration showing some of the components of another prior art embodiment of an LPP EUV system.

As above, in some cases two curtains may be generated by separate line lasers. FIG. 3 is another simplified illustration again showing some of the components of a prior art LPP EUV system such as is shown in FIG. 1, but now with two planar curtains, a first curtain 302 and a second curtain 304, both between droplet generator 106 and irradiation site 105. Curtains 302 and 304 each function similarly to curtain 202 in FIG. 2, generating a flash of laser light reflected from a droplet 107 when it passes through each curtain. Two sensors are typically used to detect the flashes from the respective curtains and provide feedback signals.

As above, the two curtains 302 and 304 are typically at different distances from irradiation site 105. For example, in one embodiment, curtain 302 may be 15 mm from irradiation site 105, while curtain 304 may be only 10 mm from irradiation site 105; again, both curtains are between droplet generator 106 and irradiation site 105. The use of two curtains may allow for better determination of the trajectory of the droplets 107, and thus for better control of any appropriate corrections to the trajectory. In some embodiments, curtain 302 may be used to control "coarse" steering provided by, for example, stepper motors, as it is further from irradiation site 105, and curtain 304 may be used to control "fine" steering provided by, for example, piezoelectric transducer ("PZT") actuators.

As is known in the art, while the laser curtains have a finite thickness, it is preferable to make the curtains as thin as is practical, since the thinner a curtain is the more light intensity it has per unit of thickness (given a specific line laser source), and can thus provide better reflections off the droplets 107 and allow for more accurate determination of droplet position. For this reason, curtains of about 100 microns (measured FWHM, or "full-width at half-maximum," as known in the art) are commonly used, as it is not generally practical to make thinner curtains. The droplets are generally significantly smaller, on the order of 30 microns or so in diameter, and an entire droplet will thus easily fit within the thickness of the curtain. The "flash" of laser light reflected off of the droplet is a function (theoretically Gaussian) that increases as the droplet first hits the curtain, reaches a maximum as the droplet is fully contained within the curtain thickness, and then decreases as the droplet exits the curtain.

As is also known in the art, it is not necessary that the curtain(s) extend across the entire plasma chamber 110, but rather need only extend far enough to detect the droplets 107 in the area in which deviations from the desired trajectory may occur. Where two curtains are used, one curtain might, for example, be wide in the y-direction, possibly over 1.0 mm, while the other curtain might be wide in the z-direction, even as wide as 30 mm, so that the droplets may be detected regardless of where they are in that direction.

Again, one with skill in the art will understand how to use such systems to correct the trajectory of droplets 107 to insure that they arrive at irradiation site 105. As above, in the case of NoMO systems, this is all that is required, since again the droplets 107 themselves form part of a cavity, along with a light source that is continuously on such as a $CO_2$ laser source, to cause lasing and vaporize the target material.

However, in MOPA systems, source laser 101 is typically not on continuously, but rather fires laser pulses when a signal to do so is received. Thus, in order to hit discrete droplets 107 separately, it is not only necessary to correct the trajectory of the droplets 107, but also to determine the time at which a particular droplet will arrive at irradiation site 105 and send a signal to source laser 101 to fire at a time such that a laser pulse will arrive at irradiation site 105 simultaneously with a droplet 107.

In particular, in MOPA PP systems, which generate a pre-pulse followed by a main pulse, the droplet must be targeted very accurately with the pre-pulse in order to achieve maximum EUV energy when the droplet is vaporized by the main pulse. A focused laser beam, or string of pulses, has a finite "waist," or width, in which the beam reaches maximum intensity; for example, a $CO_2$ laser used as a source laser typically has a usable range of maximum intensity of about 10 microns in the x- and y-directions.

Since it is desirable to hit a droplet with the maximum intensity of the source laser, this means that the positioning accuracy of the droplet for irradiation by the pre-pulse must be achieved to within about ±5 microns in the x- and y-directions when the laser is fired. There is somewhat more latitude in the z-direction, as the region of maximum intensity may extend for as much as about 1 mm in that direction; thus, accuracy to within ±25 microns is generally sufficient; there is also more latitude at the irradiation site. One of skill in the art will appreciate that other embodiments may have different tolerances than those described herein.

The speed (and shape) of the droplets may be measured as is known in the art, and is thus known; droplets may travel at over 50 meters per second. (One of skill in the art will appreciate that by adjusting the pressure and nozzle size of the droplet generator the speed may be adjusted.) The position requirement thus also results in a timing requirement; the droplet must be detected, and the laser fired, in the time it takes for the droplet to move from the point at which it is detected to the irradiation site.

One embodiment of an improved system and method of droplet detection provides a robust solution for illuminating and detecting the droplets, thus ensuring the correct timing of irradiation of the droplets by the source laser. A high quality droplet illumination laser of adjustable power, efficient light collection of reflections from the droplets, and protection of the aperture through which the droplet illumination laser is introduced into the plasma chamber are combined to achieve this result.

Figure 4:
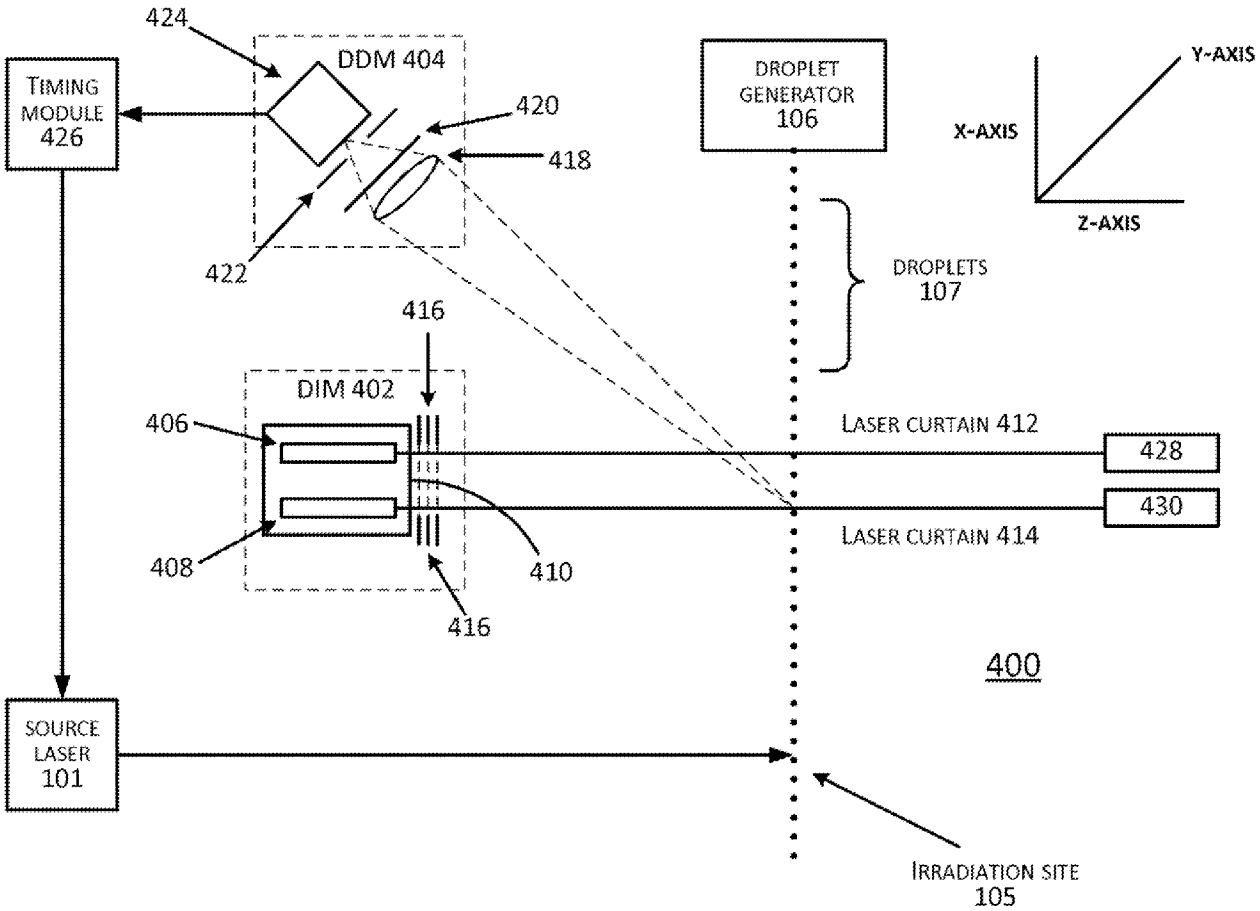
FIG. 4 is a simplified illustration of some of the components of an LPP EUV system including a droplet illumination module and droplet detection module according to one embodiment.

FIG. 4 is a simplified illustration of an LPP EUV system according to one embodiment. System 400 contains elements similar to those in the system of FIG. 1, and additionally includes a droplet illumination module (DIM) 402 and a droplet detection module (DDM) 404. As described above, droplet generator 106 creates droplets 107 which are intended to pass through irradiation site 105, where they are irradiated by pulses from source laser 101. (For simplicity, some elements are not shown in FIG. 4.)

In the illustrated embodiment, DIM 402 contains two lasers having different wavelengths. A first laser 406 in DIM 402 is a line laser with for example, an output of 2 watts and a wavelength of 806 nm, and generates a first laser curtain 412. The second laser 408 is a fiber laser source with greater power, for example, an adjustable output of about 5 to 50 watts and a wavelength of 1070 nm, and generates a second laser curtain 414. In some embodiments, the second laser 408 may also have a built in low power guide laser of, for example, 1 milliwatt and a wavelength of 635 nm. Lasers of different types, wavelengths and power may be used in some embodiments.

Both laser curtains 412 and 414 are generally planar, extending primarily in the y-z directions, but again having some thickness in the x-direction. The two curtains 412 and 414 are both located between the droplet generator 106 and irradiation site 105, and are generally perpendicular to, and slightly separated in, the x-direction. In some embodiments, curtain 412 may be located about 10 mm from irradiation site 105, while curtain 414 may be located about 5 mm from irradiation site 105.

The beams from the two DIM lasers 406 and 408 enter the plasma chamber through a viewport 410 in the DIM. The viewport may have a pellicle, i.e., a thin glass element that acts as a protective cover for the viewport, with a coating that transmits the two wavelengths of the two DIM lasers 406 and 408 and reflects the wavelength of the scattered light from the source laser 101; this helps to keep the pellicle from heating up as a result of radiative heat from the source laser 101, as well as preventing distortion of the beams from DIM lasers 406 and 408. The pellicle coating also helps to protect the viewport 410 from target material debris in the chamber.

In addition to the pellicle coating, the DIM also contains a port protection aperture 416 that further protects the pellicle and viewport from target material debris so as to increase the lifetime of the pellicle and viewport and minimize downtime of the EUV system. In the illustrated embodiment, port protection aperture 416 comprises multiply-stacked metallic elements, each having a slit that significantly limits the field of view through the viewport to the x-y planes in which the respective laser curtains are to extend.

In one embodiment, the metallic elements of port protection aperture 416 are a plurality of stainless steel plates (stainless steel deforms less due to heat than aluminum), each plate separated from the next by approximately ½ inch or more, and each about 2 mm thick. Three such plates are illustrated in FIG. 4. Each plate extends across viewport 410 in the x- and y-directions, and has a slit that is wide enough in the x- and y-directions to allow DIM lasers 406 and 408 to project laser curtains 412 and 414. This may be seen by the dashed portions of port protection aperture 416, which represent the slits in the plates. Since there are multiple plates, in some embodiments the plate farthest from the viewport may be as much as one foot away.

Because irradiation site 105 is offset from laser curtains 412 and 414 in the x-direction, i.e., further along the trajectory of droplets 107, debris coming from the direction of the irradiation site 105 will arrive at port protection aperture 416 at an angle to the plates of port protection aperture 416, rather than being perpendicular to the plates as is the case with DIM lasers 406 and 408. As a result, any debris that makes it through the slit in the first plate of port protection aperture 416 will not be traveling in a line that would pass directly through the remaining slits, and most of such debris will thus be blocked from reaching viewport 410.

As above, when droplets 107 passes through either curtain 412 or 414, flashes are created by the reflection of the laser energy in the respective curtain off of each droplet 107 and may be detected by sensors. Using lasers of different wavelengths allows the respective sensors that detect flashes from each curtain to be optimized for each wavelength and thus enhance detection of flashes from only the curtain corresponding to each sensor.

DIM laser 406 generates first laser curtain 412; the flashes created as successive droplets 107 pass through curtain 412 are detected by a first sensor 428, which may be a camera, and which is able to detect the position of droplets 107 in the y-z plane and provide such information to an actuator for droplet generator 106 as feedback to be used for droplet steering as in the prior art and described above. Sensor 428 may utilize a filter which passes the wavelength of DIM laser 406 and absorbs other wavelengths with a high contrast ratio so as to protect sensor 428 from plasma emissions from irradiation site 105.

DIM laser 408 similarly generates second laser curtain 414 that also results in flashes when droplets 107 pass through it; these flashes are detected by a second sensor 430, which may again be a camera and similarly provides information about the position of the droplets in the y-z plane. Sensor 430 may similarly utilize a filter which passes the wavelength of DIM laser 408 and absorbs other wavelengths for protection from plasma emissions. Sensor 430 may use the flashes from curtain 414 to provide for additional control over the trajectory of droplets 107 as in the prior art. In some embodiments, curtain 412 may be used to control a "coarse" adjustment of the droplet steering mechanism, and curtain 414 used to control a "fine" adjustment of droplet steering.

In addition, curtain 414 is also used for timing the firing of the source laser 101 so that a laser pulse arrives at irradiation site 105 at the same time as a droplet 107, and thus that droplet 107 may be vaporized and generate the EUV plasma. As noted above, DIM laser 408, which creates curtain 414, is preferably of a higher power than DIM laser 406. This will allow the flashes created by reflections when droplets 107 pass through curtain 414 to be brighter than the flashes from curtain 412.

When a droplet 107 passes through curtain 414, the flash created is also detected by DDM 404; however, unlike sensors 428 and 430, DDM 404 does not need to detect the position of the droplet in the y-z plane, since it is used only for timing and not for steering. For proper operation, DDM 404 should only record flashes from droplets 107 passing through curtain 414, and should ignore flashes from curtain 412 or plasma light from irradiation site 105. DDM 404 should thus be configured in a way that it is able to accurately distinguish these various events. In one embodiment, DDM 404 contains a collection lens 418, a spatial filter 420, a slit aperture 422, a sensor 424, and an amplifier board (not shown) to boost a signal from the sensor 424. If desired, DDM 404 may also include a port protection aperture (not shown) constructed in a similar fashion to the port protection aperture 416 shown for DIM 402 above, and located between collection lens 418 and sensor 424.

Collection lens 418 is oriented to collect light from the flashes created when droplets 107 pass through curtain 414 and focus that light on sensor 424, while plasma light from irradiation site 105 will not be focused on sensor 424 in the same way since it is coming from a different direction than from curtain 414. Slit aperture 422 is also oriented such that the light from curtain 414 focused by collection lens 418 will pass through to sensor 424, but plasma light from irradiation site 105 will be slightly further defocused. For further protection of sensor 424, there may be a viewport and pellicle between slit aperture 422 and sensor 424 if desired.

Sensor 424 may be, for example, a silicon diode, and is preferably optimized to detect light at the wavelength of laser diode 408, 1070 nm (or such other wavelength as may be chosen for laser diode 408), and not light at either the wavelength of laser diode 406 or the plasma light created at irradiation site 105. In combination with the greater power of the DIM laser 408, this configuration and the orientation of collection lens 418 and slit aperture 422 ensures that DDM 404 accurately and reliably detects each flash created when a droplet 107 passes through curtain 414, while ignoring flashes created when a droplet 107 passes through curtain 412 as well as the plasma light created at irradiation site 105.

When such a flash is received by sensor 424, a timing module 426 (e.g., a logic circuit) calculates the time it will take for the droplet 107 that created the received flash to reach irradiation site 105 based upon the distance from curtain 414 to irradiation site 105 and the speed of the droplet, which is again known. Timing module 426 then sends a timing signal to source laser 101 which instructs source laser 101 to fire at a time calculated to result in a laser pulse arriving at irradiation site 105 at the same time as the current droplet 107 so that droplet 107 may be vaporized and create EUV plasma.

In a typical NoMO LLP EUV system, the droplet generator may generate droplets 107 at a rate of 40,000 per second (40 KHz), while a MOPA PP system may use a rate of 50,000 K-z or higher. At a rate of 40,000 KHz, a droplet is thus generated every 25 microseconds. Sensor 424 must thus be able to recognize a droplet and then be prepared to recognize the next droplet within that time period, and timing module 426 must similarly be able to calculate droplet timing and generate and send a timing signal and be waiting for the next droplet to be recognized in the same time period.

Further, if droplets fly at 50 meters per second, and curtain 414 is 5 mm from irradiation site 105, a droplet will reach irradiation site 105 10 milliseconds after it passes curtain 414. Thus, a droplet must be sensed by DDM 404, a timing signal generated by timing module 426, that signal sent to source laser 101, and a pulse fired by source laser 101 in time for the pulse to travel to irradiation site 105 in that 10 milliseconds. In some embodiments, droplets may fly at even faster speeds. A person of ordinary skill in the art will appreciate how this may be done within such a time period, and with sufficient accuracy that the pulse will hit the droplet.

Again, the signal of a droplet 107 passing through a curtain is a Gaussian curve that is determined by the curtain beam shape cross-section. The height and width of the Gaussian curve are a function of the droplet size and velocity, respectively. However, the curtain thickness of 100 microns or more is significantly greater than the droplet size of 30-35 microns, and the actual shape of the droplet can be shown to be irrelevant. Further, the reflection of the droplet while it passes through the curtain is integrated, so that high frequency surface changes of the droplet will average out.

One of skill in the art will also appreciate that while FIG. 4 is shown as a cross-section of the system in the x-z plane, in practice the plasma chamber 110 is often rounded or cylindrical, and thus the components may in some embodiments be rotated around the periphery of the chamber while maintaining the functional relationships described herein.

Figure 5:
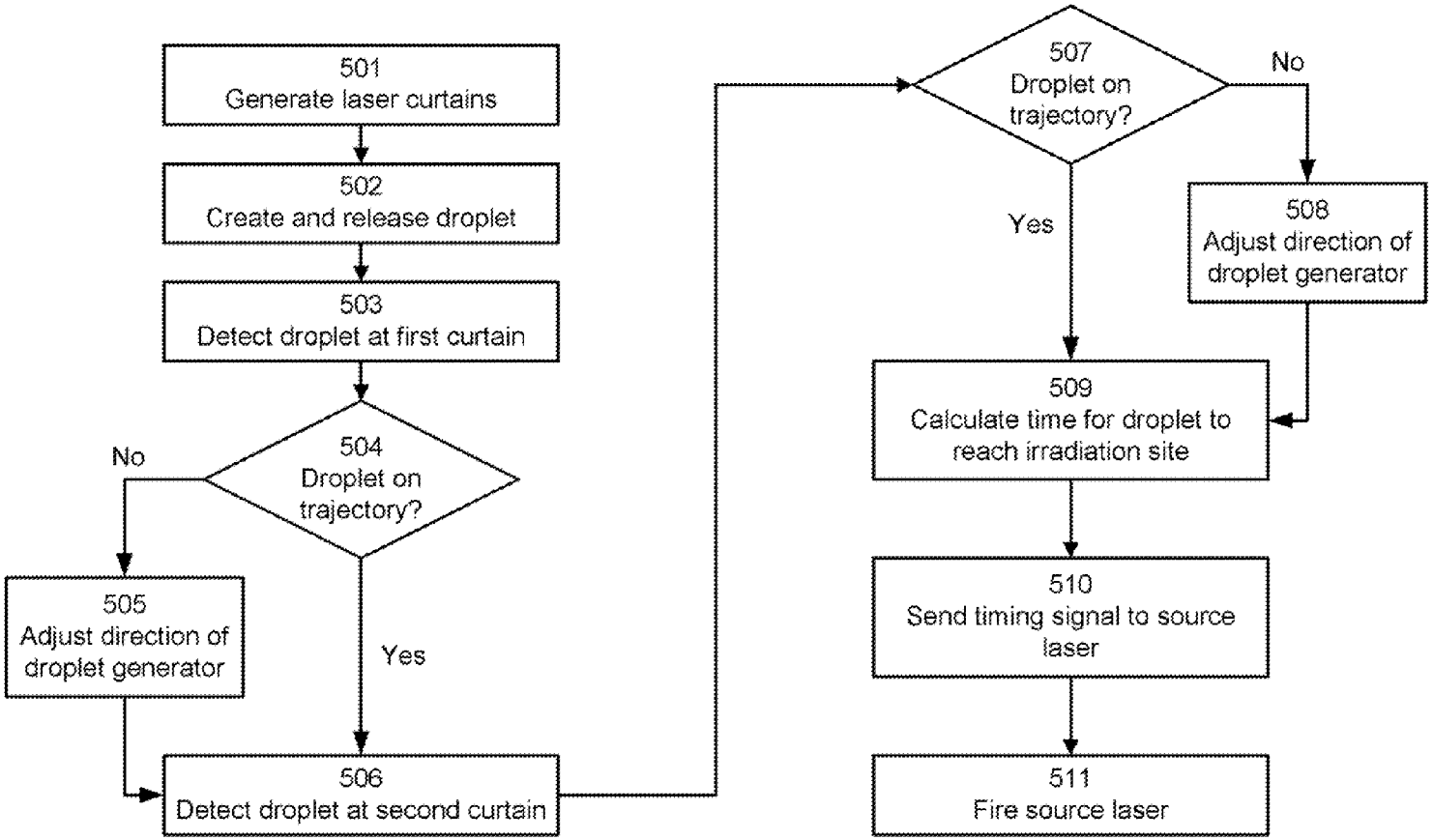
FIG. 5 is a flowchart of a method of timing the pulses of a source laser in an LPP EUV system according to one embodiment.

FIG. 5 is a flowchart of a method that may be used for timing laser pulses in an LPP EUV system, in which a droplet generator produces droplets to be irradiated by a source laser at an irradiation site, such as a MOPA or MOPA PP laser, according to one embodiment as described herein. At step 501, two laser curtains are generated as described above, such as by DIM lasers 406 and 408 in FIG. 4. As described above, both curtains are located between the droplet generator and the irradiation site at which it is desired to irradiate the droplets to produce EUV plasma.

At step 502, droplets are sequentially created, for example by droplet generator 106, and sent on a trajectory toward the irradiation site. At step 503, a droplet, such as a droplet 107, passes through the first of the two laser curtains, for example laser curtain 412 in FIG. 4, and the droplet is detected by a sensor, such as sensor 428, which detects the flash as the light of the first laser curtain is reflected off of the droplet.

At step 504, a first controller receives from the sensor data regarding the detected flash and from that data determines the position of the droplet in the y-z plane and, from that position, whether the droplet is on the desired trajectory to the irradiation site. If the droplet is not on the desired trajectory, at step 505 a signal is sent to the droplet generator indicating the direction(s) in the y-z plane in which the droplet has deviated from the desired trajectory, so that an actuator for droplet generator 106 may adjust the direction in which the droplet generator releases subsequent droplets to correct the trajectory to the desired trajectory.

Next, at step 506, the droplet is detected by the second curtain, such as laser curtain 414 in FIG. 4. Note that the method continues from the detection of a droplet at the first curtain in step 503 to the detection of the droplet at the second curtain in step 506 even if the droplet is not on the correct trajectory, as the droplets currently in motion cannot be adjusted. The adjustment of the direction in which the droplet generator releases droplets will only affect the trajectory of subsequent droplets.

Again, a sensor such as sensor 430 detects a flash from the droplet as it crosses the second curtain. At step 507, a second controller receives from the sensor data regarding the detected flash and from that data again determines the position of the droplet in the y-z plane and whether that position places the detected droplet on the desired trajectory to the irradiation site. If the droplet is not on the desired trajectory, at step 508 again a signal is sent to the droplet generator indicating the deviation from the desired trajectory so that an adjustment may be made to the direction in which the droplets are released to correct the droplet trajectory. As above, in some embodiments the signal sent in step 505 may be for a "coarse" adjustment of the droplet trajectory and the signal sent in step 508 for a "fine" adjustment of the droplet trajectory.

In addition, once a droplet has been detected crossing the second laser curtain, based upon the speed of the droplet and the distance from the second curtain to the irradiation site, at step 509 a third controller, such as timing module 426 in FIG. 4, calculates the time at which the detected droplet will reach the irradiation site, and at step 510 sends a timing signal to the source laser instructing the source laser to fire at such a time that the laser pulse will reach the irradiation site at the same time as the droplet in question. At step 511, the source laser fires a pulse at the time specified by the timing signal, and the pulse irradiates the droplet at the irradiation site.

As with the detection of the droplet by the second laser curtain at step 506 even if the droplet was not on the correct trajectory at step 504, steps 509 to 511 are performed even if it has been determined that the droplet is not on the correct trajectory at step 507 since as above the trajectory of the droplets already released cannot be altered. As with the adjustment of droplet trajectory at step 505, the adjustment of droplet trajectory at step 508 will only affect the trajectory of droplets subsequently released.

Note that this flowchart shows the treatment of a single droplet. In practice, the droplet generator is continuously generating droplets as described above. Since there is a sequential series of droplets, there will similarly be a sequential series of flashes detected, and a series of timing signals generated, thus causing the source laser to fire a series of pulses and irradiating a series of droplets at the irradiation site to create the EUV plasma. Further, as above, it is expected that in most embodiments these functions will overlap, i.e., a droplet may pass through the second curtain every 25 microseconds or faster, while it may take about 10 milliseconds for each droplet to pass from the second curtain to the irradiation site. Thus, the second controller should include a queuing function which allows for the detection of, and an appropriate timing signal for, each separate droplet.

In some embodiments, the first and second controllers (not shown in FIG. 4) and the third controller (such as timing module 426) may be logic circuits or processors. In some embodiments, a single control means, such as a processor, may serve as both the first and second controllers, while in other embodiments a single control means may serve as all three controllers.

The disclosed method and apparatus have been explained above with reference to several embodiments. Other embodiments will be apparent to those skilled in the art in light of this disclosure. Certain aspects of the described method and apparatus may readily be implemented using configurations other than those described in the embodiments above, or in conjunction with elements other than those described above.

For example, different algorithms and/or logic circuits, perhaps more complex than those described herein, may be used. While certain examples have been provided of various configurations, components and parameters, one of skill in the art will be able to determine other possibilities that may be appropriate for a particular LPP EUV system. Different types of source lasers and line lasers, using different wavelengths than those described herein, as well as different sensors, focus lenses and other optics, or other components may be used. Finally, it will be apparent that different orientations of components, and distances between them, may be used in some embodiments.

It should also be appreciated that the described method and apparatus can be implemented in numerous ways, including as a process, an apparatus, or a system. The methods described herein may be implemented in part by program instructions for instructing a processor to perform such methods, and such instructions recorded on a computer readable storage medium such as a hard disk drive, floppy disk, optical disc such as a compact disc (CD) or digital versatile disc (DVD), flash memory, etc. In some embodiments the program instructions may be stored remotely and sent over a network via optical or electronic communication links. It should be noted that the order of the steps of the methods described herein may be altered and still be within the scope of the disclosure.

These and other variations upon the embodiments are intended to be covered by the present disclosure, which is limited only by the appended claims.

What is claimed is:

1. A system for timing the firing of a source laser in an extreme ultraviolet laser produced plasma (EUV LPP) light source having a droplet generator which releases a droplet at a known speed, the source laser firing pulses at an irradiation site, comprising:

a droplet illumination module comprising a first line laser configured to generate a first laser curtain between the droplet generator and the irradiation site;

a droplet detection module comprising a first sensor configured to detect a flash when the droplet passes through the first laser curtain;

a first controller configured to:

determine, based upon the flash as detected by the first sensor, a known distance from the first curtain to the irradiation site, and the known speed of the droplet, a time when the source laser should fire a pulse so as to irradiate the droplet when the droplet reaches the irradiation site; and generate a timing signal instructing the source laser to fire at the determined time;

a second sensor configured to detect the flash when the droplet passes through the first laser curtain; and a second controller configured to determine, based upon the flash as detected by the second sensor, that the droplet is not on a desired trajectory leading to the irradiation site and providing a signal indicating an adjustment to a direction in which the droplet generator releases a subsequent droplet which will place the subsequent droplet on the desired trajectory.

2. The system of claim 1, wherein:

the droplet illumination module further comprises a second line laser configured to generate a second laser curtain between the droplet generator and the irradiation site; and the system further comprises:

a third sensor configured to detect a flash from the second laser curtain when the droplet passes through the second laser curtain; and a third controller configured to determine, based upon the flash as detected by the third sensor, that the droplet is not on the desired trajectory leading to the irradiation site and providing a signal indicating an adjustment to the orientation of the droplet generator which will place a subsequent droplet on the desired trajectory.

3. The system of claim 2 wherein the first line laser and second line laser are configured to generate the first laser curtain closer to the irradiation site than the second laser curtain.

4. The system of claim 3 wherein the first line laser and second line laser are configured to generate the first laser curtain and the second laser curtain such that the shortest distance from the first laser curtain to the irradiation site is approximately 5 mm and the shortest distance from the second laser curtain to the irradiation site is approximately 10 mm.

5. The system of claim 1 wherein the droplet illumination module further comprises a viewport between the first line laser and the desired trajectory of the droplet.

6. The system of claim 5 wherein the droplet illumination module further comprises a port protection aperture for protecting the viewport.

7. The system of claim 6 wherein the port protection aperture comprises a plurality of separated metallic elements.

8. The system of claim 1 wherein the droplet detection module further comprises a collection lens for collecting light from the flash from the droplet passing through the first laser curtain and focusing the light onto the first sensor.

9. The system of claim 1 wherein the droplet detection module further comprises a slit aperture between the collection lens and the first sensor.

10. The system of claim 1 wherein the droplet detection module further comprises a port protection aperture for protecting the first sensor.

11. The system of claim 10 wherein the port protection aperture comprises a plurality of separated metallic elements.

12. A method for timing the firing of a source laser in an EUV LPP light source having a droplet generator which releases a droplet at a known speed, the source laser firing pulses at an irradiation site, comprising:

generating a first laser curtain located between the droplet generator and the irradiation site;

detecting by a first sensor a flash when the droplet passes through the first laser curtain;

determining from the flash as detected by the first sensor that the droplet is not on a desired trajectory leading to the irradiation site and providing a signal indicating an adjustment to a direction in which the droplet generator releases a subsequent droplet which will place the subsequent droplet on the desired trajectory;

detecting by a second sensor the flash when the droplet passes through the first laser curtain; and determining, based upon the flash as detected by the second sensor, a known distance from the first curtain to the irradiation site, and the known speed of the droplet, a time when the source laser should fire a pulse so as to irradiate the droplet when the droplet reaches the irradiation site, and generating a timing signal instructing the source laser to fire at the determined time.

13. The method of claim 12, further comprising:

generating a second laser curtain located between the droplet generator and the irradiation site;

detecting by a third sensor a flash when the droplet passes through the second laser curtain; and determining from the flash as detected by the third sensor that the droplet is not on the desired trajectory leading to the irradiation site and providing a signal indicating an adjustment a direction in which the droplet generator releases a subsequent droplet which will place the subsequent droplet on the desired trajectory.

14. A non-transitory computer readable storage medium having embodied thereon instructions for causing a computing device to execute a method for timing the firing of a source laser in an EUV LPP light source having a droplet generator which releases a droplet at a known speed, the source laser firing pulses at an irradiation site, the method comprising:

generating a first laser curtain located between the droplet generator and the irradiation site;

detecting by a first sensor a flash when the droplet passes through the first laser curtain;

determining from the flash as detected by the first sensor that the droplet is not on a desired trajectory leading to the irradiation site and providing a signal indicating an adjustment to a direction in which the droplet generator releases a subsequent droplet which will place the subsequent droplet on the desired trajectory;

detecting by a second sensor the flash when the droplet passes through the first laser curtain; and determining, based upon the flash as detected by the second sensor, a known distance from the first curtain to the irradiation site, and the known speed of the droplet, a time when the source laser should fire a pulse so as to irradiate the droplet when the droplet reaches the irradiation site, and generating a timing signal instructing the source laser to fire at the determined time.

* * * * *